United States Patent [19]

DuHamel

[11] Patent Number: 4,658,262

[45] Date of Patent: Apr. 14, 1987

[54] DUAL POLARIZED SINUOUS ANTENNAS

[76] Inventor: Raymond H. DuHamel, 707 Continental Circle, Apt. 1627, Mountain View, Calif. 94040

[21] Appl. No.: 703,042

[22] Filed: Feb. 19, 1985

[51] Int. Cl.[4] ..... H01Q 11/10; H01Q 1/36

[52] U.S. Cl. ..... 343/792.5; 343/895

[58] Field of Search ..... 343/792.5, 806, 895, 343/853

[56] References Cited

U.S. PATENT DOCUMENTS 4,243,993 1/1981 Lamberty et al. ..... 343/895

4,490,725 12/1984 Kuo ..... 343/792.5

OTHER PUBLICATIONS

Johnson and Jasik: *Antenna Engineering Handbook,* Second Edition, McGraw-Hill Book Co., 1984, Chapter 14.

Jasik: *Antenna Engineering Hand Book,* McGraw-Hill, 1961, pp. 18-14 and 18-15.

*Antenna Capabilities Catalog,* 1981, GTE Systems, Sylvania Systems Group, Western Division, p. 34.

*Primary Examiner*—Eli Lieberman

*Attorney, Agent, or Firm*—Flehr, Hohbach, Test, Albritton & Herbert

[57] ABSTRACT

A sinuous antenna having N identically generally sinuous arms extending outwardly from a common point and arranged symmetrically on a surface at intervals of 360°/N about a central axis. Each antenna arm comprising cells of bends and curves. Each cell being interleaved without touching between adjacent cells of an adjacent antenna arm.

42 Claims, 24 Drawing Figures

DUAL POLARIZED SINUOUS ANTENNAS

This invention relates to wide bandwidth sinuous antennas with two orthogonal senses of polarization and particularly to sinuous antennas with both senses of circular polarizations, and more particularly to dual circularly polarized sinuous antennas with pattern, gain, impedance and bandwidth properties similar to the singly circularly polarized Archimedes and log-spiral antennas. The *American Heritage Dictionary* defines the adjective sinuous as "characterized by many curves or turns; winding." Sinuous as used herein, is generalized to characterize lines consisting of curves or curves and sharp turns or bends, or straight lines and sharp turns with the sharp turns or bends occurring in an alternating fashion. Thus, zigzag curves are included in this definition.

The Archimedes spiral and log-spiral (also called equiangular spiral) antennas have been used for several decades to provide essentially frequency independent performance over extremely wide bandwidths. Refer to Johnson and Jasik, "Antenna Engineering Handbook," Second Edition, McGraw-Hill Book Co., 1984, Chapter 14 entitled "Frequency Independent Antennas" for discussions of Archimedes spiral and log-spiral antennas as well as log-periodic antennas. As discussed in the following pages, a special class of sinuous antennas are the log-periodic antennas.

The most useful spiral antennas and some of the most proliferate antennas have been two arm planar, cavity backed structures with unidirectional rotationally symmetric patterns, a single sense of circular polarization and a very low axial ratio over a hemisphere. The cavity is loaded with absorbing material in order to achieve wide bandwidths. The most important applications have been for direction finding and surveillance systems.

The Archimedes spiral arms are defined by curves of the form $$r=a\phi+b \tag{1}$$

where r and $\phi$ are the polar coordinates "a" is a constant which determines the rate of expansion of the spiral and "b" is a parameter which is varied to define the width of the arms of a strip line structure. The arm width may be chosen so that the structure is self-complementary to ensure that the input impedance is independent of frequency for the "infinite spiral" and has a free space impedance of $60\pi$ ohms. For a fixed value of $\phi$, the conductor configuration is a periodic function of the radial distance. r. For a two arm spiral with the arms fed out of phase, most of the radiation takes place in an annular ring with a circumference of one wavelength. The currents on the arms are attenuated traveling waves which are essential for circular polarization and a rotationally symmetric pattern. The sense of circular polarization is reversed by changing the sign of "a" in Equation (1) which is equivalent to winding the spiral in the opposite direction.

The log-spiral arms are defined by curves of the form $$r=\exp(a\phi+b) \tag{2}$$

where the constant "a" again determines the rate of expansion and "b" is varied to define the width of the spiral arms. Again, the arm widths may be chosen so that the structure is self-complementary. The log-spiral antennas are defined only by angles and satisfy the frequency independent condition developed by Rumsey. For a fixed value of $\phi$, the conductor configuration is a periodic function of the logarithm of the radius in this case. The period is $\ln \tau$ where $\tau=\exp(-|a\pi|)$ for a two arm structure. It may be shown that the log-spiral is invariant to a scaling by the factor $\tau$. For $\tau$ somewhat less than one, the electrical characteristics of the Archimedes spiral and log-spiral antennas are essentially the same over finite bandwidths.

Special techniques may be used to achieve both senses of circular polarization with spiral antennas over limited bandwidths. A two arm spiral may be fed from both the inside and outside terminals to achieve both senses of circular polarization over a bandwidth less than 3:1. A four arm spiral may be fed by two different "normal modes" at the inside terminals to produce both polarizations for a bandwidth less than 3:1. A larger number of arms may be used to increase the bandwidth but the complexity of the feed circuitry makes it impractical.

Amplitude and/or phase comparison techniques with two two-arm spirals may be used for one-dimensional direction finding. Four arm spirals making use of monopulse type sum and difference patterns or four tilted beams may be used for two-dimensional direction finding.

Previous attempts to use four or more log-periodic elements placed on a planar surface to provide two orthogonal senses of polarization with electrical properties and physical dimensions similar to the spiral antennas have been unsuccessful. A technique for interleafing the elements so as to achieve the desired diameter without destroying the frequency independent characteristics had not been discovered.

Conical spiral structures may be used to achieve unidirectional patterns without an absorbing cavity and have gains several db greater than the planar spirals.

Crossed log-periodic dipole antennas are used to provide both senses of circular polarization with a low axial ratio on the peak of the unidirectional pattern which is on the axis of the antenna. However, the axial ratio increases rapidly off axis because of the large difference in the E and H plane beamwidths of a log-periodic dipole antenna.

Long or narrow angle log-periodic strip type zigzag antennas have been placed on the sides of a square pyramid to produce undirectional patterns with both senses of circular polarization over wide bandwidths with equal E an H plane beamwidths of 40°. However, the width of a side of the pyramid in the active or radiating region is about $\lambda/2$ ($\lambda$=wavelength) and the diagonal length in this region is $\lambda/\sqrt{2}$. The zigzags can extend beyond the sides of the pyramid and cross each other so as to increase the beamwidth (spirals have a nominal beamwidth of 70°). However, the diameter of the active region is still too large and the radiating elements do not lie on a common surface. The tips of the straight line zigzags could be bent at the corners so that they would lie on a common surface but they would either touch adjacent zigzags or would have unequal spacings to adjacent strips of an adjacent zigzag which is undesirable. Thus, previous efforts to achieve performance comparable to the spiral antennas in the same volume with both senses of circular polarization by means of log-periodic antennas have been unsuccessful.

Frequency independent antennas are defined by angles. Log-periodic antennas are defined by angles and a design ratio $\tau$ (tau) and may be considered as a cascade of P cells of metal conductors. The dimensions of one cell are related to those of an adjacent cell by $\tau$. A quasi log-periodic antenna may be achieved by letting $\tau$ and the angles defining a cell be a function of the cell number, p. Extremely wide bandwidths may be achieved with quasi-log-periodic antennas if modest changes in $\tau$ and the angles are made from one cell to the next.

It is a primary object of this invention to provide a quasi-log-periodic sinuous antenna, and in the special case a log-periodic sinuous antenna, having a bandwidth which is essentially unlimited as in the case of spiral and log-periodic antennas, having two orthogonal senses of polarization and particularly both senses of circular polarization, having radiation beams similar to the spiral antennas and having a physical size similar to the spiral antennas.

It is another objective of this invention to provide log-periodic quasi-log-periodic sinuous antennas in which the beamwidth can be controlled to a greater extent than that for the spiral antennas.

It is still another objective of this invention to provide quasi-log-periodic sinuous antennas in which the beamwidth can be controlled and varied with frequency.

It is a further objective of this invention to provide dual circularly polarized log-periodic and quasi-log-periodic sinuous antennas which have directive patterns with low axial ratios and with low side-lobes and low back-lobes.

It is a further objective of this invention to provide dual circularly polarized log-periodic and quasi-log-periodic sinuous antennas with sum and difference patterns or four tilted beams for direction finding applications.

It is a still further objective of this invention to provide dual circularly polarized log-periodic and quasi-log-periodic sinuous antennas which may be used to measure the axial ratio of a received wave.

Briefly, the foregoing and other objectives of this invention are achieved by an antenna comprising N conducting arms, where N is greater than two, emanating from a central point and laying on a plane or a conical surface. The arms are equally spaced and are similar such that a rotation of 360/N degrees of the antenna structure about its central axis leaves the structure unchanged. The arms are defined by sinuous curves which are log-periodic or quasi-log-periodic in nature and which oscillate back and forth with increasing radius over a sector of the surface. The arms are interleafed and defined so that they do not touch or cross each other. A single mode may be excited by feeding the arms with voltages of equal magnitude and a progressive phase shift of 360 m/N degrees where the mode number m is an integer. Mode numbers 1 and $-1$ produce sum patterns with opposite senses of circular polarization. Mode numbers 2 and $-2$ produce rotationally symmetric difference patterns with opposite senses of circular polarization. Tilted beams in various directions may be produced by simultaneous excitation of the sum and difference modes.

A better understanding of the invention may be obtained by reference to the following description, taken in conjunction with the accompanying drawings, in which.

Figure 6:
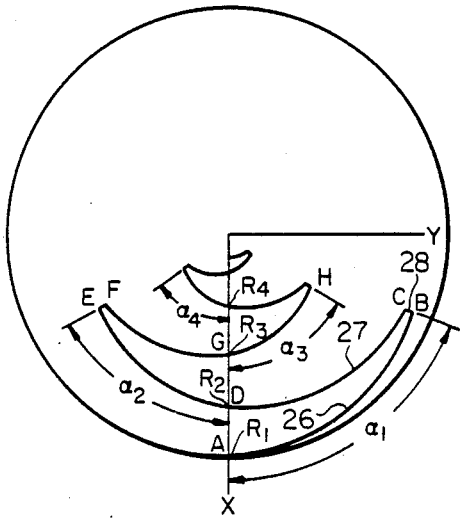
FIG. 6 shows a curve composed of linear-log type cells which may be used to define the arms of an N arm quasi-log-periodic sinuous antenna.
Figure 7A:
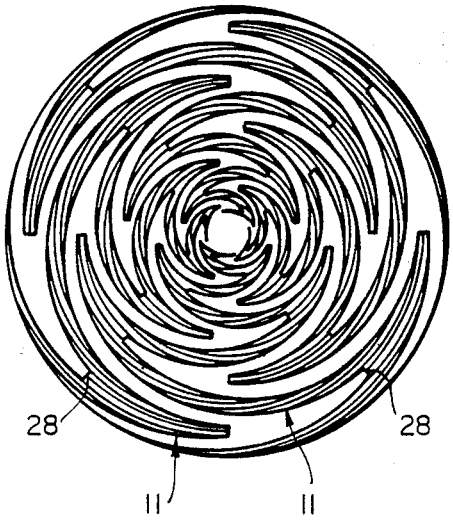

FIG. 7*a* shows a top view of a self-complementary four arm quasi-log-periodic sinuous antenna based upon the curve of FIG. 6.

Figure 7B:
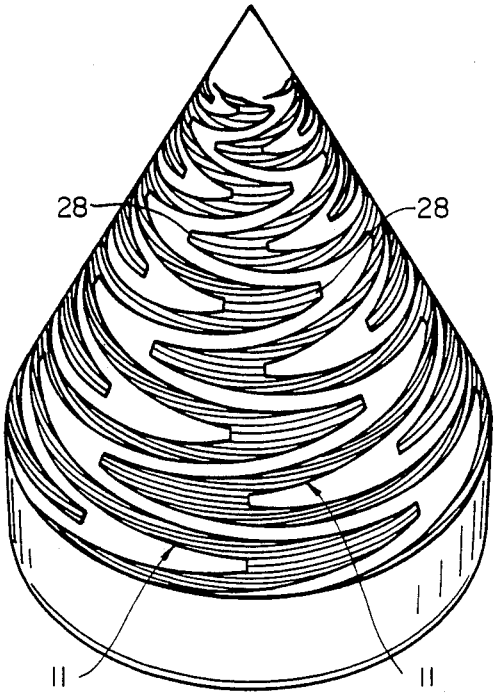

FIG. 7*b* shows a perspective view of a conical four arm sinuous antenna based upon the curve of FIG. 6.

Figure 8:
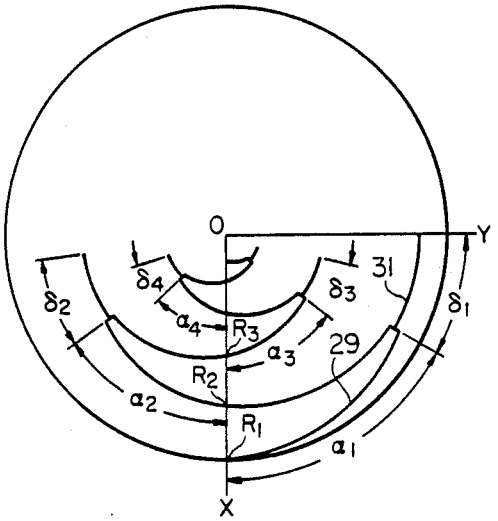

FIG. 8 shows a single arm of an N arm sinuous wire antenna composed of linear-log type cells.

Figure 9:
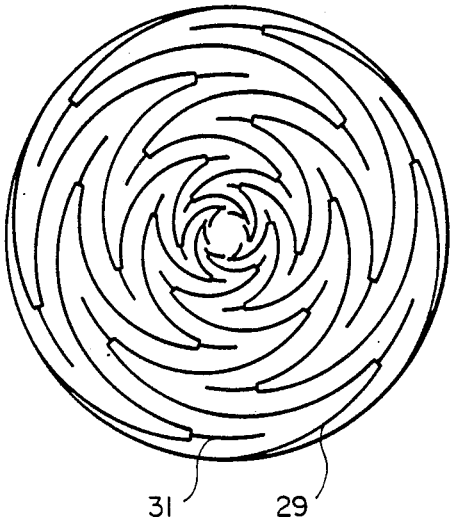

FIG. 9 shows a top view of a four arm quasi-log-periodic sinuous wire antenna based upon the curve of FIG. 8.

Figure 10:
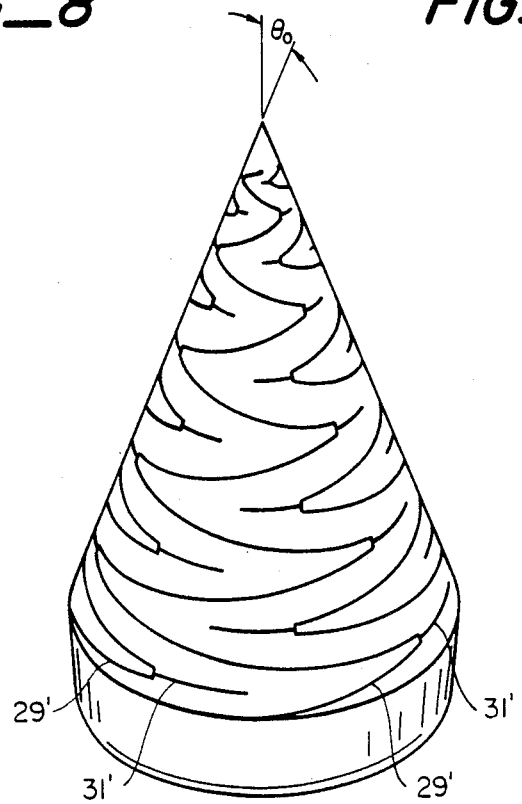

FIG. 10 is a perspective view of a conical four arm sinuous wire antenna based upon the curve of FIG. 8.

Figure 11:
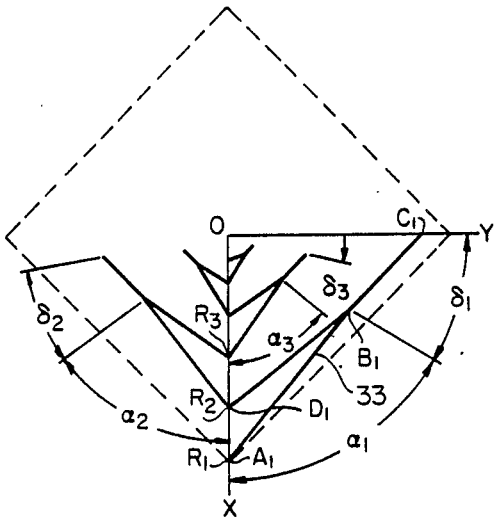

FIG. 11 shows a single arm of a four arm sinuous wire antenna composed of linear type cells with three linear segments per cell.

Figure 12:
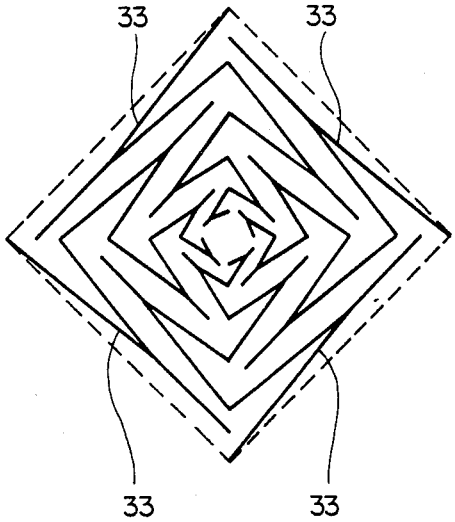

FIG. 12 shows a top view of a four arm quasi-log-periodic sinuous wire antenna based upon the wire arm of FIG. 11.

Figure 13:
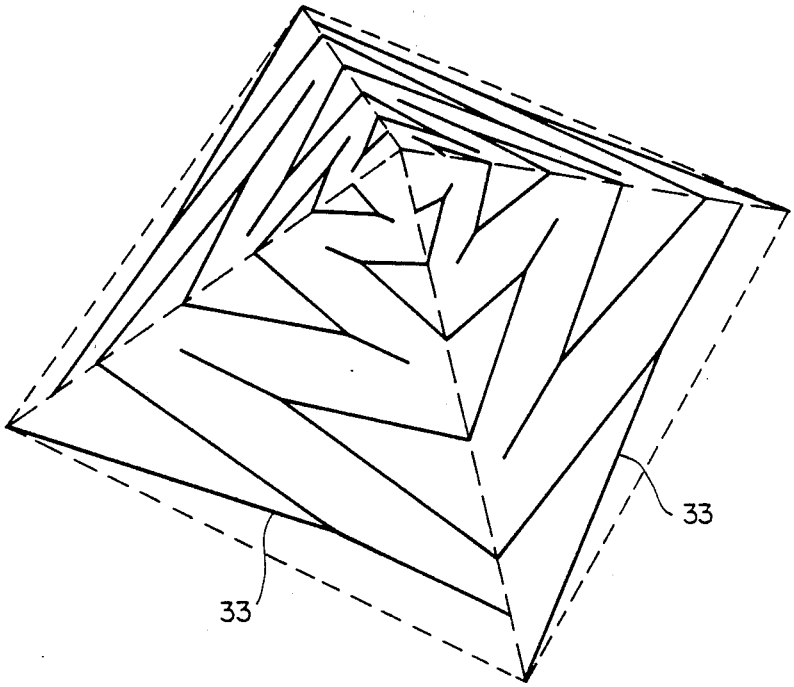

FIG. 13 shows a perspective view of a pyramidal four arm sinuous wire antenna based upon the linear type cells of FIG. 11.

Figure 14:
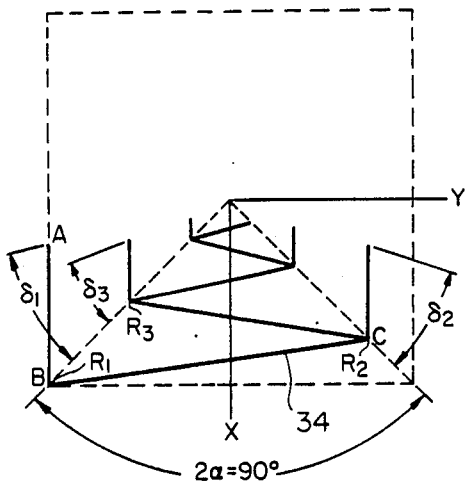

FIG. 14 shows a single arm of a four arm linear sinuous wire antenna composed of cells with two linear segments per cell.

Figure 15:
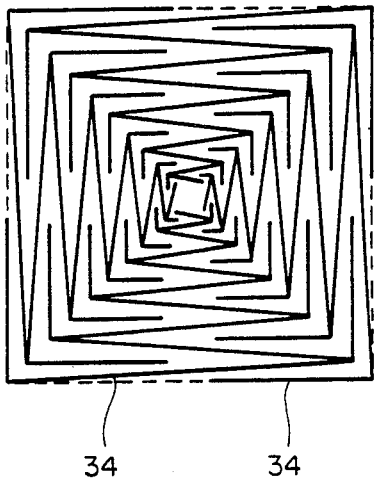

FIG. 15 shows a top view of four arm linear sinuous wire antenna based upon the wire arm of FIG. 14.

Figure 16:
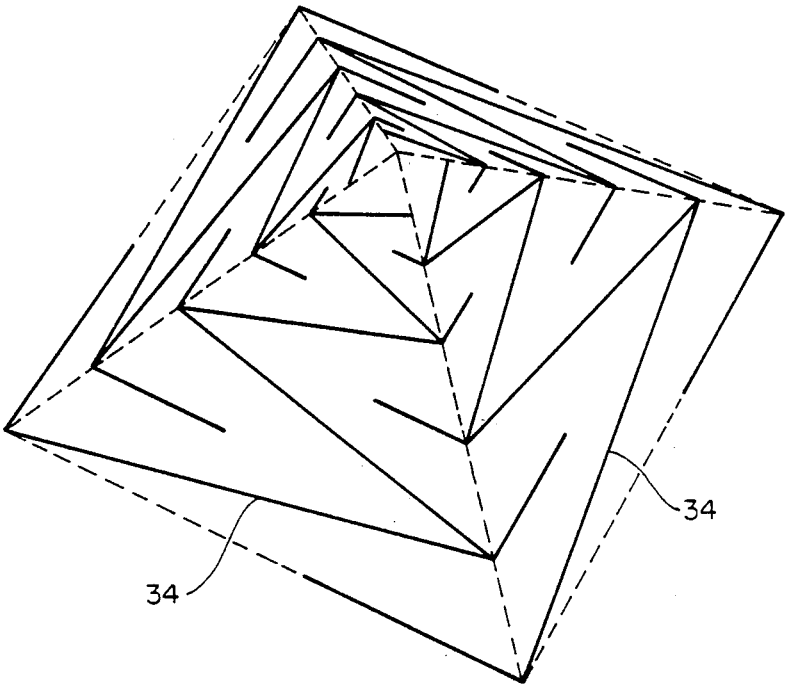

FIG. 16 shows a perspective view of a pyramidal four arm linear sinuous wire antenna based upon the wire arm of FIG. 14.

Figure 17:
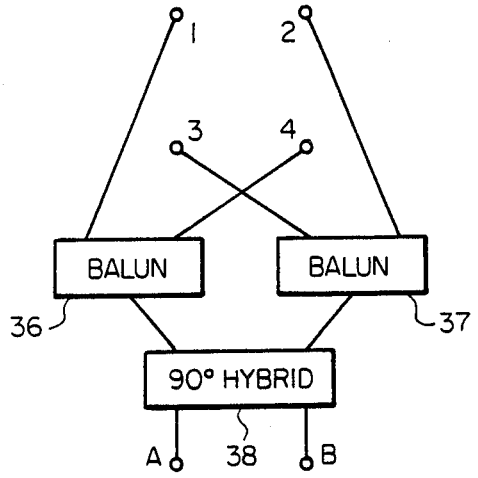

FIG. 17 is a schematic diagram of a feed network for a four arm sinuous antenna.

Figure 18:
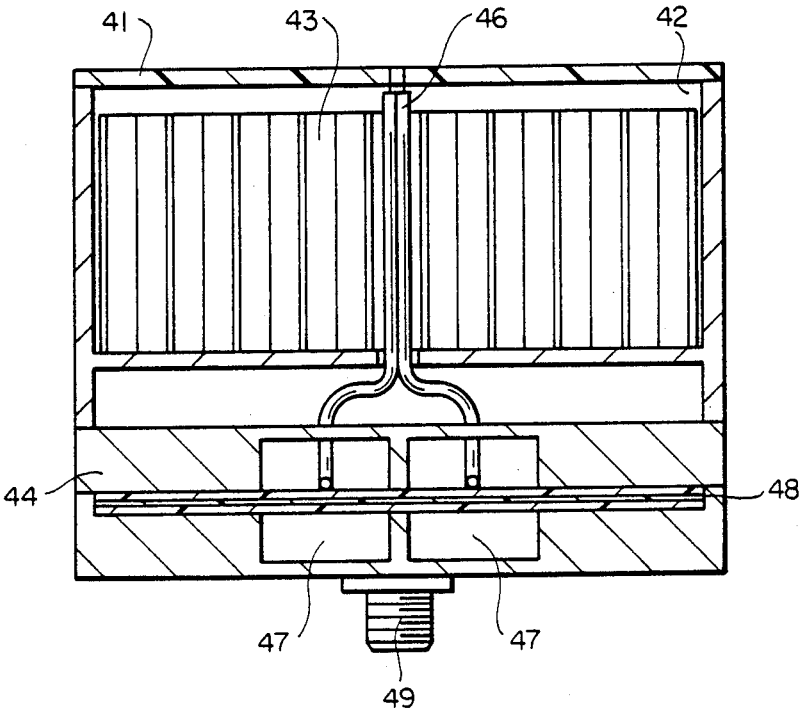

FIG. 18 is a cross-sectional view of a planar cavity backed sinuous antenna showing the absorbing cavity and feed network.

Figure 19:
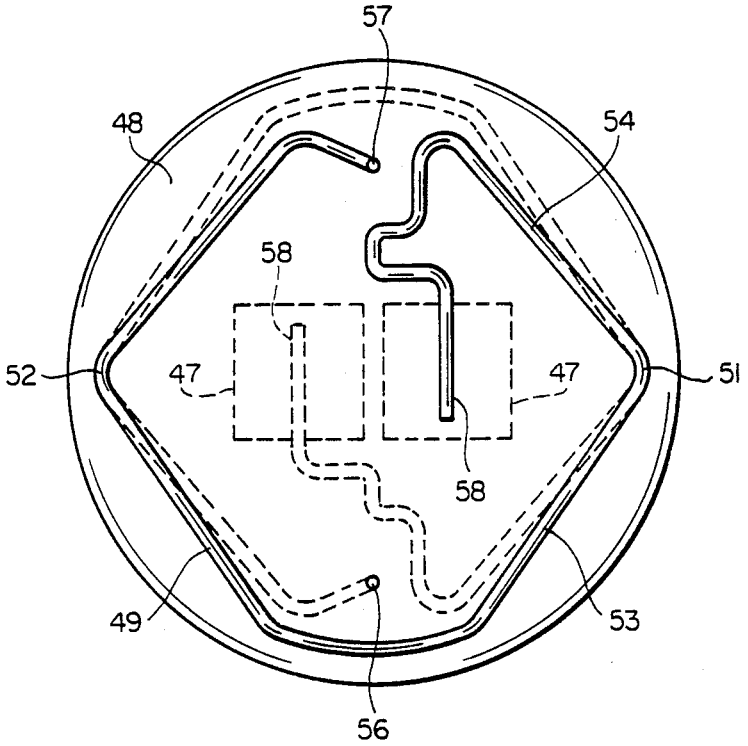

FIG. 19 is a top view of a printed circuit feed network for the antenna of FIG. 18.

FIG. 20 shows two views of the balun used in the feed network of FIG. 18.

Figure 21:
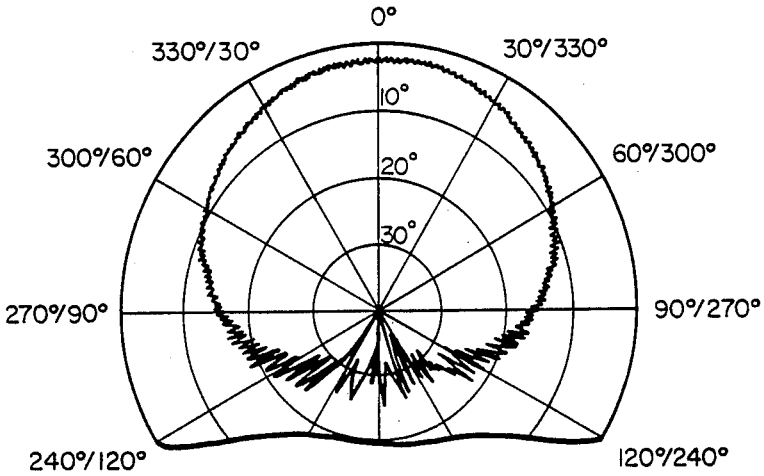

FIG. 21 shows a measured radiation pattern of a four arm linear-log sinuous wire antenna.

Figure 22:
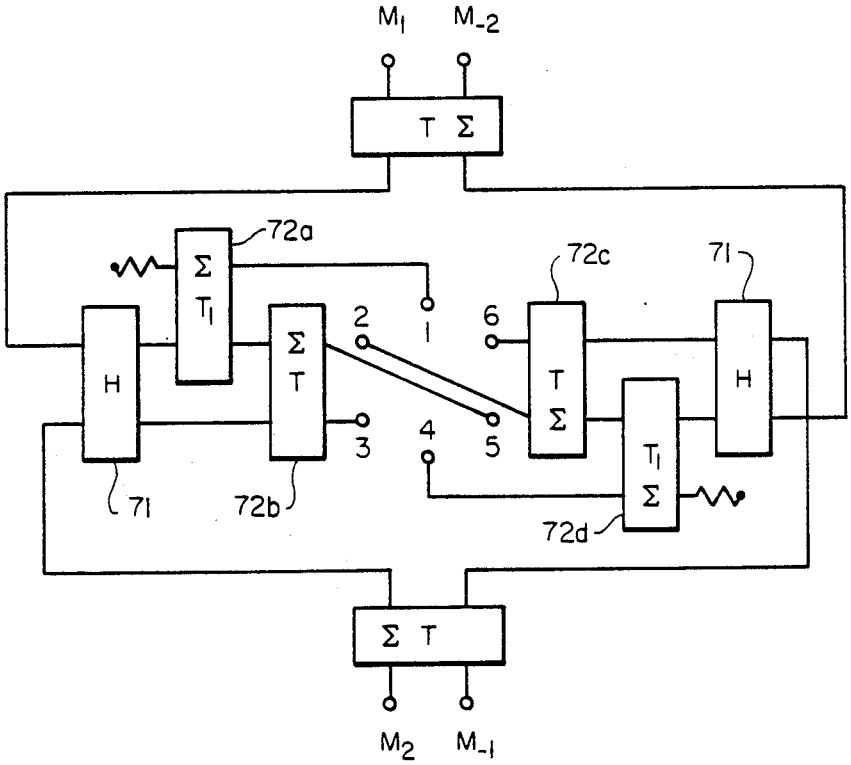

FIG. 22 is a schematic diagram of a feed network for producing sum and difference patterns for both senses of circular polarization for a six arm sinuous antenna.

Figure 23:
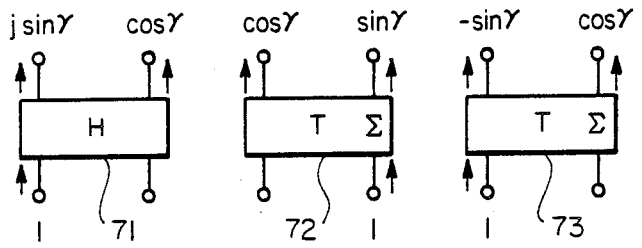

FIG. 23 shows schematic diagrams which define output functions of hybrids.

Figure 24:
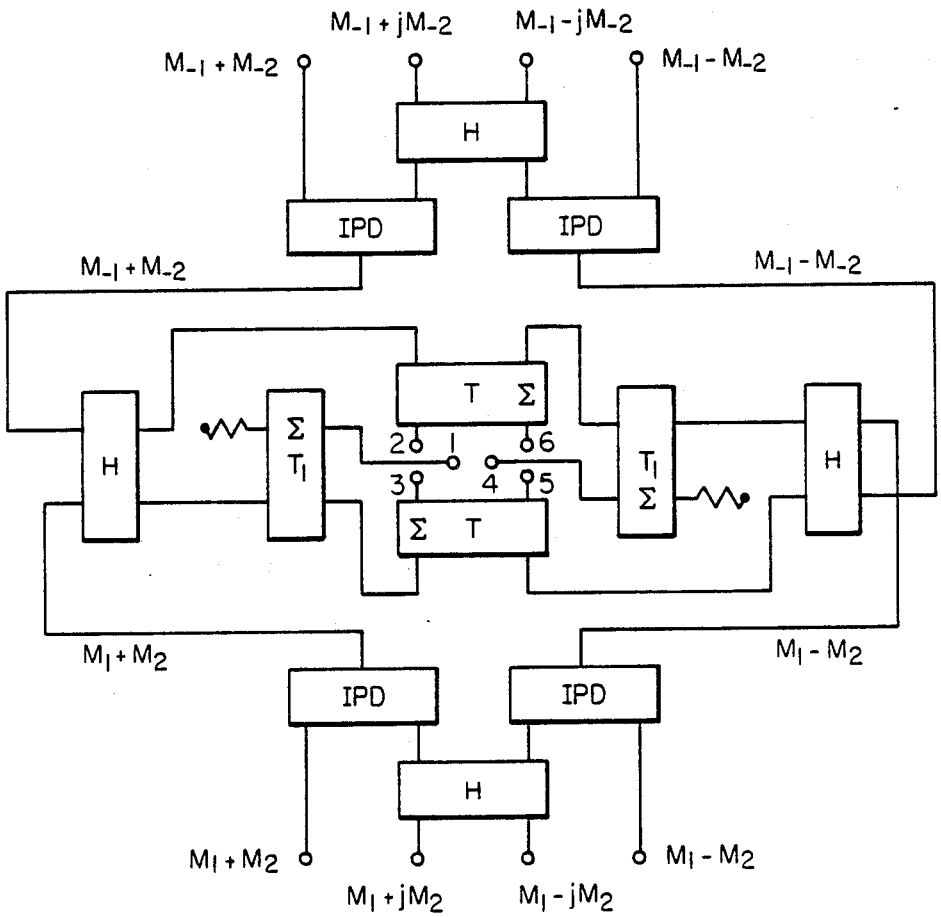

FIG. 24 is a schematic diagram of a feed network for producing four tilted beams for both senses of circular polarization for a six arm sinuous antenna.

Figure 1:
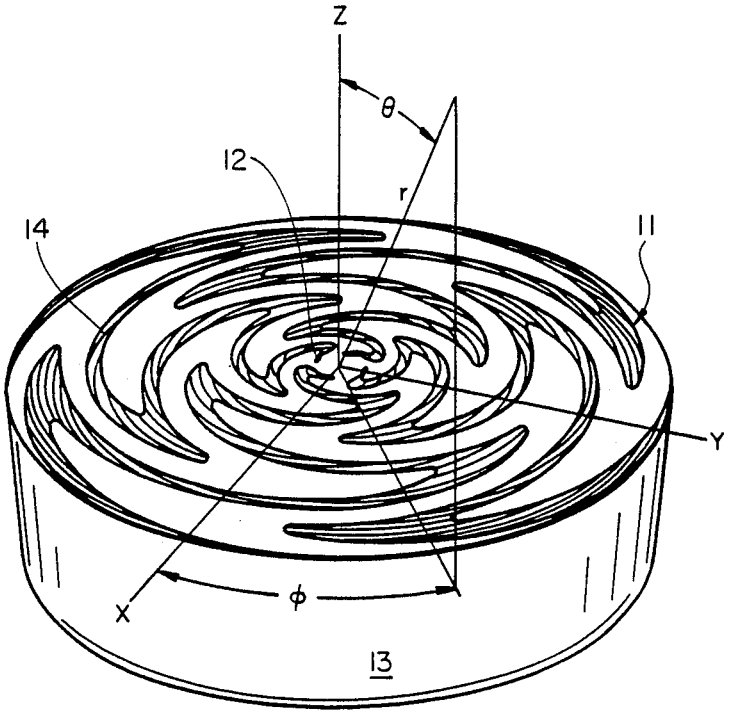
FIG. 1 is a perspective view of a cavity backed four arm planar quasi-log-periodic sinuous antenna.

An antenna in accordance with an embodiment of the invention is shown in FIG. 1 with the spherical coordinate system r, $\theta$, $\phi$. It consists of four sinuous arms 11 lying on a plane and emanating from a central point 12 located near the Z axis. The arms interleaf each other without touching and are defined such that a rotation of the antenna of 90° about the Z axis leaves the antenna unchanged. The arms are excited by a feed network and a four wire transmission line (not shown) connected to the arms at the inner-most points 12 so as to produce currents with equal magnitudes and a progressive phase shift of +90° or −90° to achieve two senses of circular polarization (CP). The antenna is placed over a conducting cavity 13 (usually filled with absorbing material) so as to produce a rotationally symmetric unidirectional pattern with the peak on the Z axis. The feed network, which may consist of two baluns and a 3 db 90° hybrid, may be placed underneath the cavity. The four wire transmission line runs from the bottom of the cavity along the Z axis to the feed points 12. Without the cavity, the antenna produces a rotationally symmetric bi-directional pattern with opposite senses of CP in opposite directions. The arms consist of metal strips 14 with widths which increase with distance from the center. Printed circuit board techniques may be used to obtain strips with a width and thickness of a few thousandths of an inch.

Figure 2:
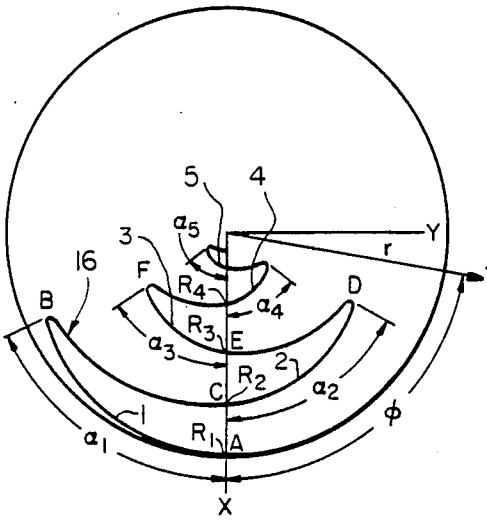
FIG. 2 shows a curve composed of a sine-log type cells which may be used to define the arms of an N arm quasi-log-periodic sinuous antenna of the type shown in FIG. 1.

The sides of the sinuous arms are defined by curves related to the curve 16 shown in FIG. 2. In general the curve consists of P cells numbered 1 to P. The line ABC forms cell number 1, the line CDE forms cell number 2, and so on. The radii $R_p$ define the outer radius of each cell. The design parameters $\alpha_p$, a positive number, and $\tau_p$, a positive number less than 1, define the angular width and ratio of inside to outside radius for each cell, respectively. The equation for the curve of the $p^{th}$ cell is given by $$\phi = (-1)^P \alpha_p \sin\left(\frac{180\ln(r/R_p)}{\ln\tau_p}\right) \text{ for } R_{p+1} \leqq r \leqq R_p \tag{3}$$

where r and $\phi$ are the polar coordinates of the curve. The radii $R_p$ are related by $$R_p = \tau_{p-1} R_{p-1} \tag{4}$$

This type of cell is termed a sine-log cell. If $\alpha_p$ and $\tau_p$ are independent of p, then the curve is a log-periodic function of the logarithm of the radius r. If $\alpha_p$ and $\tau_p$ are not independent of p then we may refer to the curve as a quasi-log periodic curve or a tapered alpha and tau curve.

If we define $\tau_p$ by $$\tau_p = \frac{1 - p(1 - \tau_1)}{1 - (p - 1)(1 - \tau_1)} \text{ for } p > 1 \tag{5}$$

then the radial lengths of the cells are identical. If, in addition, $\alpha_p$ is independent of p, then the curve is a periodic function of the radius. In this case the curve may be defined by $$\phi = \alpha \sin(180\, P\, r) \tag{6}$$

where P is the number of cells for a normalized radius of $R_1 = 1$. These cells are termed sine cells. For $\tau$ close to one there is little difference between the sine-log and sine cells. This type of curve is analogous to the Archimedes spiral curve.

Figure 3:
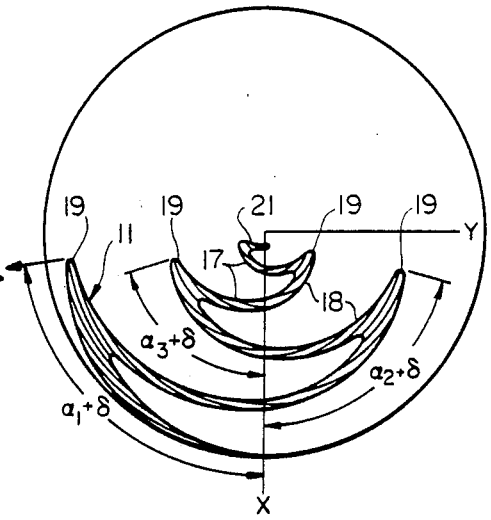
FIG. 3 shows a single arm of an N arm sinuous antenna based on the curve of FIG. 2.

FIG. 3 shows a single sinuous arm of the antenna of FIG. 1, defined by two curves 17,18 for the $p^{th}$ cell of the form $$\phi = (-1)^P \alpha_p \sin\left(\frac{180\ln(r/R_p)}{\ln\tau_p}\right) \pm \delta \text{ for } R_{p+1} \leqq r \leqq R_p \tag{7}$$

The two curves have the same shape as the curve of equation (3) but are rotated plus or minus $\delta$ degrees about the origin. The tip or outermost point of a cell occurs at the angle $\alpha_p + \delta$ with respect to the centerline of the arm. The arm resembles a wide angle log-periodic zigzag antenna which has been distorted and curved to fit into a circular region. In contrast to a normal wire zigzag antenna the width of a sinuous arm within a cell varies with distance along the arm and the extra metal in the form of a protrusion 19 at the sharp bends forms shunt capacitive loading at these points. The four arms of the sinuous antenna behave as transmission lines weaving back and forth in a sinuous manner and supporting essentially an outward traveling wave when excited from the center. Radiation from a sinuous arm is small except in radial regions where the electrical path length of a cell is approximately an odd multiple of $\lambda/2$ where $\lambda$ is the wavelength. In this case, the circumferential currents at the beginning and ending of a cell are in phase since they are traveling in opposite directions but one current is delayed 180° in phase with respect to the other. These regions are termed active regions and for the full antenna the active regions of the four arms form annular regions or rings with a radial width of a fraction of a wavelength. The first active region occurs approximately when $$r(\alpha_p + \delta) = \lambda/4 \tag{8}$$

where the angles are expressed in radians. It is important that the attenuation of the traveling wave through this first active region be large so that radiation from higher order active regions is negligible. If each cell of a sinuous arm had a constant arm width then there would be a large reflection at each sharp bend. An equivalent circuit for the bend is a series inductance in the transmission line representation of the cell. In the active region the reflectance from the bends are spaced approximately $\lambda/2$ and add up to produce unacceptable patterns and VSWR. The shunt capacitive loading described above produces reflections which tend to cancel the bend reflections, especially for the self-complementary design which is described later.

Radiation from the spiral antennas in the sum mode occurs in the $\lambda$ ring which has a circumference of $\lambda$ wherein traveling wave currents of the form exp ($j\phi$) exist and produce circular polarization. The basic idea here for the four arm sinuous antenna is to establish the equivalent of standing wave currents of the form sin $\phi$ and cos $\phi$ for orthogonal pairs of arms and excite the balanced pairs of arms with equal current magnitudes but with +90° or −90° phasing to achieve the equivalence of traveling waves of the form exp ($\pm j\phi$). The radiation from each cell of the single sinuous arm of FIG. 3 may be represented as the sum of the radiation from traveling wave currents flowing in opposite directions in the two halves of the cell. The sum of the two currents is a standing wave which is approximately a sinusoidal function. Thus when $\alpha_p + \delta \approx 90°$ and equation (8) is satisfied the currents in orthogonal pairs of arms approximate the sin $\phi$ and cos $\phi$ distributions.

The bandwidth is controlled by the radii $R_1$ and $R_p$ and values of $\alpha_p$ and $\delta$ for the first and last cells. The low frequency cutoff occurs approximately when $$R_1(\alpha_1+\delta)=\lambda_L/4 \quad (9)$$

where $\lambda_L$ is the wavelength at the low frequency cutoff. If $\alpha_1+\delta=\pi/2$, then $R_1=\lambda/2\pi$. The high frequency cutoff occurs when $$R_p(\alpha_p+\delta)<\lambda_H/4 \quad (10)$$

where $\lambda_H$ is the wavelength at the high frequency cutoff. In order to obtain good pattern and impendance behaviors it is necessary to have a "transition region" 21 between the feedpoints and the active region at the high frequency cutoff. A reasonable compromise is to use $$R_P(\alpha_P+\delta)=\lambda_H/8 \quad (11)$$

The frequency bandwidth ratio, FR, is then given by $$FR=\frac{\lambda_H}{\lambda_L}=\frac{R_1(\alpha_1+\delta)}{2R_P(\alpha_P+\delta)} \quad (12)$$

The bandwidth may be increased at will by increasing $R_1$ and/or decreasing $R_p$. Ten to one bandwidths in the microwave range have been obtained.

The beamwidth, BW, of the radiation pattern for the active region is inversely proportional to the radius of the active region, i.e., $$BW\,\alpha\,\frac{1}{(\alpha_p+\delta)} \quad (13)$$

With $\delta=22.5°$ and $\alpha=45$, 55 and 65 degrees, the average 3 db beamwidths are approximately 60, 70, 80 degrees respectively. For a log-periodic sinuous antenna the beamwidth is essentially independent of frequency for frequencies greater than that for which the total active region is within the radius $R_1$. For quasi-log-periodic or tapered $\alpha$ structures, it is possible to vary the beamwidth with frequency by an appropriate variation of $\alpha_p$ with p (or effectively with radius). The control of beamwidth is a luxury provided by the sinuous antennas that is not available with spiral antennas.

For a given bandwidth the $\tau_p$ parameters determine the number of cells in the structure. For simplicity of construction, it is desired that $\tau_p$ be small. For large attenuation through the first active region and therefore frequency independent performance, $\tau_p$ must be larger than some minimum value which may be determined experimentally. Measurements indicate that $\tau_p$ should be greater than 0.65 in order to obtain rotationally symmetric patterns with low axial ratios over a wide range of view (like over a hemisphere).

Figure 4:
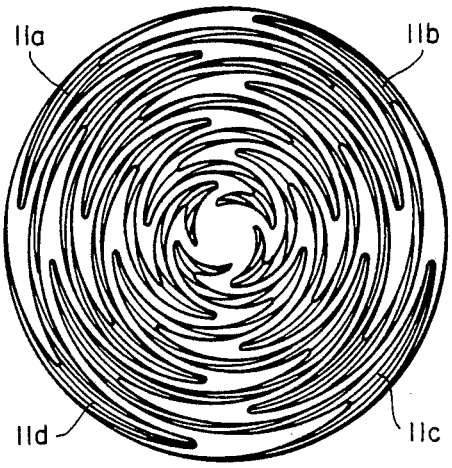
FIG. 4 shows a top view of a periodic self-complementary four arm sinuous antenna based upon the curve of FIG. 2.

FIG. 4 is a top view of a four arm 11*a*, 11*b*, 11*c*, 11*d* periodic sinuous antenna with $\alpha=60°$, $\delta=22.5°$ and $P=8$ (see equation (6)). Only six sine type cells are used for each arm so as to simplify the drawing. Notice that the structure is a periodic function of the radius r. Notice also that this structure is self-complementary, i.e., if we replace the metal strips by space and the space between the strips by metal within the radii $R_1$ and $R_{p+1}$ then the structure is unchanged except for a rotation of 45° about the Z axis. As discussed later, the input impedance of an arm to ground is independent of frequency for the infinite structure and is equal to 133Ω. Increasing or decreasing $\delta$ from 22.5° decreases or increases the arm impendance respectively.

In general, sinuous antennas may consist of N arms lying on the surface of a plane, cone or pyramid with a rotational symmetry such that a rotation of 360/N degrees about the central axis leaves the structure unchanged. The antenna may be excited in one or more of the normal modes, or eigenvectors, to produce a variety of useful patterns. The voltage excitations for a normal mode are given by $$V_{n,m}=A_m \exp(j\,360\,m\,n/N) \quad (14)$$

where $n=1, 2, \ldots N$ is the arm number;

$m=+1, +2, \ldots$ is the mode number; and $A_m$ is the amplitude of the excitation of mode m and may be a complex number.

The designation $M_m$ is introduced for convenience in describing combinations of modes. It represents the excitation of all N arms in mode m. Mode $M_N$ is usually not used since it requires in phase excitation of the arms against an additional conductor. An arbitrary excitation of the antenna may be represented as a summation of the normal modes given by (14). It is obvious that mode $M_{-m}$ is identical to mode $M_{N-m}$. All modal patterns have a rotationally symmetric pattern and all modal patterns have a null on the axis of rotation except for modes $M_1$ and $M_{-1}$. Feed networks may be designed (see later paragraphs) to provide isolated feeds for the individual modes or combinations of the modes. N must be greater than two in order to provide two patterns with orthogonal polarizations. Modes $M_1$ and $M_{-1}$ are used to provide sum patterns with orthogonal senses of circular polarization. Mode combinations $M_1+M_{-1}$ and $M_1-M_{-1}$ are used to provide sum patterns with orthogonal senses of linear polarization. It should be apparent that the modal amplitudes $A_1$ and $A_{-1}$ are 1 and $\pm 1$ for these combinations.

N must be greater than four in order to provide two rotationally symmetric difference patterns with orthogonal senses of polarization. Modes $M_2$ and $M_{-2}$ are used to provide difference patterns with opposite senses of circular polarization. Modes $M_1$ and $M_2$ are used to provide monopulse type direction finding for one sense of circular polarization and modes $M_{-1}$ and $M_{-2}$ are used for the other sense of circular polarization. Mode combinations $M_2+M_{-2}$ and $M_2-M_{-2}$ may be used to provide difference patterns with orthogonal senses of linear polarization. However, the linear polarization patterns are not very useful for direction finding and homing applications because of polarization errors.

For direction finding and homing systems it is often desirable to have an antenna with four orthogonal tilted beams. This may be achieved by combinations of sum and difference modes. For one sense of circular polarization, mode combinations $M_1+M_2$, $M_1-M_2$, $M_1+jM_2$ and $M_1-jM_2$ are used to provide four orthogonal tilted beams. The other sense of circular polarization is obtained by changing the signs of the above mode numbers. A three db loss in the feed network is incurred since eight beams are obtained from only four normal modes.

The condition that an N arm sinuous antenna be self complementary is $$\delta=180/2N \quad (15)$$

Infinite planar N arm self-complementary structures in free space have the very important property that the elements of the N×N impedance matrix are real and independent of frequency. Deschamps (see above reference) has shown that when the arms of a rotationally symmetric structure such as that of FIG. 4 are excited with voltages of mode $M_m$ that the input impedance to ground of each arm is given by $$Z_m = \frac{30\pi}{\sin\left(\frac{180\,m}{N}\right)} \tag{16}$$

This self-complementary property leads to some important observations. Since there are no reflections at the inputs for an infinite structure when the structure is fed in a normal mode with voltage generators with impedances equal to the normal mode impedance, it is concluded that either there are no reflections at the sharp bends or that all of the bend reflections add up to zero at the input independently of frequency. The latter possibility is difficult to accept. Regardless though if the attenuation through the first active region is large, such as 10 to 20 db, then the end effect (reflections from the outer edge of the structure or radiation from other regions past the active region) will be small and the antenna will exhibit approximate frequency independent performance. As mentioned previously, it is believed that the protrusions or stubs at the bends provides reflection free bends.

Although the first successful sinuous antennas were self-complementary, this is not a necessary condition as will be evidenced for antennas described below. The self-complementary condition was also invoked by DuHamel, (U.S. Pat. No. 2,985,879) to produce the first successful log-periodic antenna but later studies showed that this condition was not at all necessary. However, the use of this condition has provided insight to design approaches and frequency independence criteria.

Figure 5:
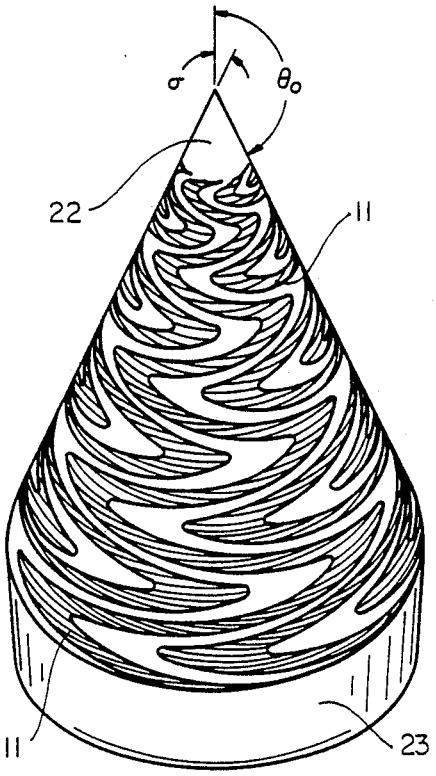
FIG. 5 is a perspective view of a log-periodic conical six arm sinuous antenna based upon the curve of FIG. 2.

FIG. 5 is a perspective view of a six arm 11 log-periodic sinuous antenna placed on a cone 22 with a half angle of $\sigma$ which equals $180-\theta_0$. The curves defining the arms are similar to those of FIG. 2 except that now FIG. 2 is considered as a top view of the conical structure and r is considered as the distance from the vertex to a point on the cone. The projection of r on the cone to the xy plane is simply r sin $\theta_0$. The antenna has the design parameters $\sigma=20°$, and $\delta=15°$. The design parameters $\alpha_p$ and $\tau_p$ vary from 45° to 60° and 0.7 to 0.9 respectively. This antenna can be excited in modes $M_1$, $M_{-1}$, $M_2$ and $M_{-2}$ to produce rotationally symmetric sum and difference pattern for both senses of circular polarization. As with the spiral antennas, the conical structure provides unidirectional patterns in the direction of the zenith. The front to back ratio increases as $\sigma$ decreases and is greater than 10 db for $\sigma$ less than about 30°. An absorbing cavity 23 may be placed at the base of the cone to reduce pattern perturbation due to reflections from the feed network and supporting structure. The advantage of the conical structure is that the gain is several db greater than the gain for a planar structure. For the absorber loaded cavity backed planar structure, at least half of the power is absorbed in the cavity and resistive terminations on the arms. The conical structure may be modified to fit an ogive shape commonly used for missiles and high speed aircraft. The active region for the conical structure occurs when $$r\,(\alpha_p+\delta)\,\sin\theta_0 \approx \lambda/4 \tag{17}$$

in a manner similar to that for the planar structures. The frequency bandwidth ratio is given by equation (12). For $\sigma=90°$ the six arm sinuous structure becomes a planar structure and an absorbing cavity is required to obtain unidirectional patterns over wide bandwidths.

There is an important difference between sinuous and spiral antennas with regard to the difference patterns. For the first difference mode of the spiral antennas, radiation takes place in a ring which has a 2λ circumference and traveling wave currents of the form exp (j2$\phi$) which produce a rotationally symmetric circularly polarized difference pattern (null on axis). It may be argued in a manner similar to the above paragraph that traveling wave currents of the form exp (±j2$\phi$) may be approximated with an N arm sinuous antenna, N>4, provided the arms are fed with phase progressions of "720/N degrees. However, these currents exist in the same active region as that for sum pattern (mode±1). Thus, the difference lobe peaks are further off axis from the sum lobe peaks for the sinuous antenna than for the spiral antenna.

There is an unlimited variety of curves which may be used to define the sinuous antennas. The curve of equation (3) is a sinusoidal function of the logarithm of the radius. The curve for each cell could also be defined as a sinusoidal function of the radius or some other oscillation function of the radius. Studies of curves defined by sinusoidal functions to the T'th power disclosed that no advantage is obtained by making T different than one. An important criteria for an optimum curve is one that maximizes the construction dimensional tolerances. For microwave applications, the arm widths and spacing between arms may be a few thousandths of an inch. An optimum curve may be defined as one which makes the arm widths and spacing commensurate. Curves which come closer to meeting this criteria are described below.

FIG. 6 shows a curve consisting of cells for which each cell is composed of two curves 26,27 and a straight line 28 such as curves AB and CD and the straight line BC for cell number 1. The two curves and straight line are linear functions of the logarithm of the radius. The equation for the first segment of the p'th cell is given by $$\phi = \frac{2\alpha_p(-1)^p \ln\left(\frac{r}{p}\right)}{(1-K)\ln\tau_p} \text{ for } R_p\tau_p^{\frac{(1-K)}{2}} R_p \leqq r \leqq R_p \tag{18}$$

where K is a parameter defining the width of the flat top. For the first cell this is the curve AB of FIG. 6. The equation for the straight line segment or flat top is given by $$\phi = \alpha_p(-1)p \text{ for } R_p\tau_p^{\frac{(1+K)}{2}} \leqq r \leqq R_p\tau_p^{\frac{(1-K)}{}} \tag{19}$$

The equation for the last curved segment is $$\phi = 2\alpha_p(-1)^p \frac{\left(\ln\tau_p - \ln\left(\frac{r}{R_p}\right)\right)}{(1-K)\ln\tau_p} \text{ for} \tag{20}$$

-continued $$R_p\tau_p \leqq r \leqq R_p\tau_p^{\frac{(1+K)}{2}}$$

Equations (19) and (20) correspond to line segments BC and CD respectively for the first cell. As before $\alpha_p$ and $\tau_p$ may be a function of p to provide tapered alpha and tau structures.

A single arm of a linear-log sinuous antenna may be defined by two curves of the form of FIG. 6, but rotated $+\delta$ and $-\delta$ degrees similar to the method used to define the sine-log sinuous arm of FIG. 3. FIG. 7*a* is a top view of a four arm 11 self-complementaery linear-log sinuous antenna. The design parameter $\alpha_p$ varies from 50° to 70° from the inside to outside respectively. The parameter $\tau_p$ varies from 0.6 to 0.8 over the same region. This top view can be considered that view for either a planar or conical structure. FIG. 7*b* shows a perspective view of a four arm conical linear-log sinuous antenna with a half cone angle of 25° and $\delta=22.5°$. The design parameters $\alpha_p$ and $\tau_p$ vary from 55° to 70° and 0.7 to 0.9 respectively.

Antenna structures based upon curves like equation (3) are termed sine-log sinuous antennas and those based on equations (18)–(20) will be termed linear-log sinuous antennas. If the curves are plotted on a rectangular plot with $\phi$ the abcissa and ln r the ordinate, it will be seen that the linear-log curve is a piece-wise linear approximation to the sine-log curve. The flat top width, K, is approximately the fractional radial width of the cell. It is set in the range of 0.1 to 0.2 in order to reduce tolerance problems at the sharp bends of the cell. The linear-log curve increases the minimum spacing between the arms about 30% compared to the sine-log curve for sinuous antennas. The linear-log curve simply gives a better distribution of metal and space in the antenna aperture. This is very important because of fabrication tolerances for microwave applications where the arm widths and spacings may be a few thousandths of an inch.

The arms of the sin-log and linear-log sinuous antennas resemble the conventional log-periodic zigzag antennas which have straight strips or wires connecting alternating sharp bends and are planar or bi-planar wherein the planar structure is bent along the centerline of the zigzag. However, there are several important differences between the sinuous arms and the conventional zigzag arms. First and most important, the strips connecting the sharp bends for the sinuous arms are curved in an especial manner such that the arms can interleaf on a common surface without touching or crossing each other and such that one arm is approximately equally spaced from an adjacent arm in the interleaf region. It should be apparent from the previous figures that this is not possible with conventional straight line zigzags except for small interleaf regions. With small interleaf regions that radiation patterns will not be rotationally symmetric and the antenna diameter is much larger than that for a spiral antenna and of course much larger than that for sinuous arms, with large interleaf regions. Second, for the conical sinuous arms, the strips connecting the sharp bends are curved in two dimensions, one to fit the cone and the other to accomplish the large interleaf region as described above. Third, the quasi-log periodic sinuous arms can be made self-complementary which is not possible with straight line zigzags, even if they are formed to fit the surface of a cone.

The arms 11 of the above structures are formed by strips 28 laying on a surface of a plane or a cone. As discussed previously the invocation of the self-complementary condition given by equation (14) is not necessary to achieve frequency independent performance. FIG. 8 shows a single arm of a wire linear-log sinuous antenna in which the arm 29 is defined by the curve of FIG. 6 plus the curved protrusions or stubs 31 defined by the angles $\delta_p$. With the risk of confusion, $\delta_p$ here defines the length of the stub whereas it was used previously to define the rotation of curves for the strip structures. Since the radius of the active region is related to $\alpha_p+\delta_p$ for both the strip and wire structures, a new parameter was not defined for the stub length. The stubs 31 are attached at a radius given by $\sqrt{\tau_p}\,R_p$ for the $p^{th}$ cell. Thus, the equation for the $p^{th}$ stub curve is $$r = \sqrt{\tau_p}\,R_p \text{ for } \alpha_p \leqq |\phi| \leqq \alpha_p + \delta_p \tag{21}$$

where $\phi$ is positive for p even and negative for p odd. $\delta_p$ is defined as a positive number. The stubs 31 at the sharp bends produce reflections which tend to cancel the reflections due to the bends. The arms may be constructed of conducting wires, rods, tubes or strips. Ideally, the cross-sectional dimensions of the arms should be proportional to the radius, but practically, constant cross-sectional dimensions may be used to achieve large frequency bandwidths. The advantage of this approach is that it is much simpler to prepare the artwork for printed circuit production of the antennas. A disadvantage is that the characteristic impedance of the arms may be too large. This may be overcome to some extent by making he wire diameter or strip width large enough to resemble a self-complementary structure at the input region or by tapering the cross-sectional dimensions of the arms with radius to provide a low impedance structure. The design parameters $\alpha_p$ and $\tau_p$ may be tapered with radius to control the beamwidth variation. FIG. 9 shows a top view of a four arm linear-log sinuous antenna with $\tau$ varying from 0.5 to 0.82, $\alpha$ varying from 42° to 50° and the stub angle $\delta$ varying from 16° to 20°. The first and second numbers of each pair refer to the values at the inside and outside regions of the structure respective. FIG. 10 is a perspective view of a conical four arm linear-log sinuous antenna having arms 29' and stubs 31' with $\theta$ varying from 0.5 to 0.92, $\alpha$ varying from 50° to 70° and $\delta$ varying from 20° to 30°. The half cone angle is 20°. The curved wire sinuous arms differ from log-periodic wire zigzag antennas not only in the manner described above for sin-log and linear-log sinuous antennas but also in the fact that the stubs are added at the sharp bends.

It is not necessary to use curves to define the strip and wire sinuous antennas since the curves may be approximated by straight line segments. For applications in the UHF or lower frequency ranges it may be more practical and/or desirable to use linear wire or rod structures placed on planar or conical surfaces rather than curved structures which are easily realized on printed circuit boards. The question then is how many segments per cell must be used to achieve performance similar to that of the curved structure. The answer is three for a four arm linear sinuous antenna with the cell type 33 shown in FIG. 11 which shows only one arm. Each cell is defined by four points such as $A_1$, $B_1$, $C_1$, $D_1$ for cell number 1. The polar coordinates r and $\phi$ of point $A_p$ are represented by the notation $A_p(r,\phi)$ with similar notations for $B_p$, $C_p$ and $D_p$. The points are defined by $$A_p(R_p, 0) \tag{22}$$

$$B_p\left(\frac{R_p\tau_p^{\frac{1}{2}}}{\sqrt{2}\,\sin(135-\alpha_p)}, \alpha_p(-1)^p\right)$$

$$C_p\left(\frac{R_p\tau_p^{\frac{1}{2}}}{\sqrt{2}\,\sin(135-\alpha_p-\delta_p)}, (-1)^p(\alpha_p+\delta)\right)$$

$$D_p(R_p\tau_p, 0)$$

for the $p^{th}$ cell.

The cell is formed by drawing straight lines between these points. Again, $\alpha_p$, $\tau_p$ and $\delta_p$ may be varied with the cell number to control the beamwidth and cutoff frequencies.

FIG. 12 is a top view of a four arm 33 linear wire sinuous antenna with $\tau$ varying from 0.5 to 0.82. $\alpha$ varying from 40° to 60° and $\delta$ varying from 20° to 30°. This can be interpreted as a view of a planar antenna or a pyramidal antenna. The dashed lines represent an imaginary square placed around the antenna. An application in the HF frequency range would be to use a planar wire structure supported above ground by four poles placed at the corners of the square with the wire antenna supported by dielectric wires running along the diagonals of the square. The antenna produces a beam directed to the zenith and provides two orthogonal senses of polarization. For a planar structure the elevation pattern will be frequency dependent because of the fixed height above ground., This problem may be overcome by using a pyramidal linear wire sinuous antenna such as shown in FIG. 13. It has the same design parameters as that for FIG. 12 but the structure is projected onto a square pyramid with a half-angle of 45°. If the structure is inverted and placed with the vertex at ground level, then the elevation patterns are essentially frequency independent.

For higher frequencies the dashed lines could represent the outline of a backing cavity. At first sight, there appears to be little advantage in using linear wires in a square cavity compared to curved wires in a circular cavity. However, the square radiators provide a more compact structure for one and two dimensional arrays of dual polarized antennas.

The linear wire sinuous arms shown in FIGS. 11, 12, and 13 differ from conventional log-periodic wire zigzags which have straight wires connecting the sharp turns in several respects. First, the cells are bent toward the vertex in an especial manner such that one arm interleafs adjacent arms as described previously with the constraint that the cells remain on a common surface. Two straight lines now connect alternating sharp bends. Second, stubs are added at the sharp bends such that they do not touch adjacent arms. Third, for the pyramidal structure, the zigzag is bent in two dimensions to fit the pyramid and to accomplish the desired interleaf.

For frequencies in the VHF range or higher it is usually desirable to use rods or tubes to form the radiating elements. FIG. 14 shows a single arm 34 of a linear sinuous antenna which has only two linear segments per cell if we consider a cell as the line ABC. Since the $\alpha$ angle is fixed at 45°, this antenna does not have the versatility of the previous antenna. The polar coordinates of the points are given by $$A_p\left(\frac{R_p}{T_2\sin(135-\delta p)}, (-1)^p(45+\delta p)\right)$$

$$B_p(R_p, (-1)^p 45)$$

$$C_p(\tau_p R_p, -(-1)^p 45)$$

FIG. 15 shows a top view of a planar or pyramidal structure having arms 34 with $\tau$ varying from 0.6 to 0.9 and $\delta$ varying from 20° to 40°.

FIG. 16 is a perspective view of a linear sinuous antenna with a pyramidal half-angle of 45° with $\tau$ varying from 0.5 to 0.82 and $\delta$ varying from 18° to 30°. This structure could be supported by dielectric wires or tubes at the corners of the pyramid. This structure is more rugged and simpler to fabricate than that of FIG. 13 since the junctions of three conducting wires or tubes occur at the corners rather than the faces of the pyramid.

The linear wire sinuous arms of FIGS. 14, 15, and 16 differ from wire zigzag antennas in the sense that stubs are added at the sharp bends. The stubs are added in a special manner such that they lie on the common surface and interleaf adjacent arms with approximately equal spacing to adjacent cells of adjacent arms.

The design of linear sinuous antennas with $N>4$ and a minimum number of linear segments per cell is straight forward. $N=5$ and 7 are to be avoided since the feed networks are rather complicated. $N=6$ is preferred over $N=8$ because fewer components are required for the feed network. For $N=6$, the antenna is designed so that it has 60° rotational symmetry. The pyramidal structure has a hexagonal cross-section. Bends occur at the corners.

For all of the structures described, the angular width of a cell is equal to $(\alpha+\delta)$ in which $\alpha$ and/or $\delta$ may be a function of the cell number, p. The amount of interleaf between adjacent arms depends upon these angles and the angle 360/N degrees between adjacent arms. We may define an interleaf ratio. ILR, as the ratio of the angular interleaf range to the angle between arms. It is given by $$ILR = \frac{N(\alpha+\delta)}{180} - 1 \tag{22}$$

ILR is zero if $(\alpha+\delta)=180/N$. For example, with $N=4$, $ILR \leqq 0$ for $(\alpha+\delta) \leqq 45°$ and $ILR \leqq 45°$ and $ILR \leqq 0$ for $(\alpha+\delta) \geqq 45°$. For $ILR=1$, the tip of a cell extends to the centerline of the adjacent arm. If $\alpha$ and/or $\delta$ vary with cell number, ILR gives an approximate average interleaf ratio of cell p on one arm to cells $(p+1)$ and $(p-1)$ on the adjacent arm.

In order to achieve rotationally symmetric patterns and an antenna diameter comparable to spiral antennas, ILR must be greater than about 0.2. Values less than 0.2 are considered a small interleaf. Values of ILR considerably greater than one should be avoided since the diameter of the active region becomes too small for sufficient radiation from the active region.

Referring to FIG. 14, it is seen that if $\alpha_p$ is independent of p and we set $\delta_p=0$, then the structure becomes a simple wire straight line log-periodic zigzag element with $\alpha=45°$. It is readily apparent from FIG. 15 that $\alpha$ can be increased by only a small amount before adjacent zigzags touch each other. For $\tau=0.7$ the maximum allowable ILR is 0.17. ILR decreases as $\tau$ is increased. These results will apply if the planar structure is projected onto a cone. However, these results are academic, since log-periodic zigzags without stubs do not work unless $\alpha$ is about 15° or less, even if strips are substituted for the wires.

An alternate approach could be to wrap and interleaf small angle zigzags, $\alpha \leqq 15°$, around a small angle cone. This approach has not been reported in the literature. It may be shown that adjacent zigzags touch when $\alpha$ satisfies the following equation $$\alpha - \frac{180 \sin \sigma}{N} = \tan^{-1}\left(\frac{1-\tau}{1+\tau} \cot \alpha\right) \tag{23}$$

As $\tau$ is increased, $\alpha$ decreases and consequently ILR decreases. The design parameter $\tau$ must be chosen to make the radial cell length less than about $0.08\lambda$ in order to make the zigzag element work well. This leads to the condition $$\tau \geqq 1 - 0.32 \tan \alpha \tag{24}$$

With the 15° limitation on $\alpha$ the cone half-angle $\sigma$ must be less than 20° to achieve an appreciable interleaf. For $\sigma=15°$, ILR=0.64 with $\tau=0.91$ and $\alpha=19°$. The realizable ILR will be considerably less than this since it is necessary to reduce $\alpha$ in order to prevent the touching and to take into account the fabrication tolerances. For $\sigma=10°$, ILR=0.76 with $\tau=0.95$ and $\alpha=14°$. Again, the realizable ILR is considerably less than this. Thus, it is possible that straight wire (or strip) zigzags might work for cone angles of about 10° or less. However, it is much better to use curved zigzags since this provides approximately equal spacing between arms in the innerleaf region which in turn provides less coupling between arms. In addition, cone angles of 10° or less are not practical for most applications because of their excessive length.

FIG. 17 shows a schematic diagram for the feed network of a four arm sinuous antenna. The baluns 36 and 37 are connected to opposite arms 1, 3 and 2, 4 of the antenna to provide the required 180° relative phasing. The 3 db quadrature (or 90°) hybrid 38 provides two input ports, A and B, which produce progressive arm phasings of plus or minus 90° as required for the two senses of circular polarization.

FIGS. 18, 19 and 20 are sketches showing one embodiment of a planar, cavity backed four arm sinuous antenna with a feed network of the type shown in FIG. 17. FIG. 18 is a cross-sectional view of the central section of the structure. The sinuous antenna is etched on the top of a planar printed circuit board 41. A cylindrical cavity, 42 is placed below the antenna. The inside diameter of the cavity is about $\lambda/3$ at the low cutoff frequency. Absorbing material 43 which is usually in a honey comb form, is placed inside the cavity. The baluns and 90° hybrid are enclosed in the metal housing 44. Four coaxial lines 46 (only two are shown in this cross section view) run from the antenna surface to the balun cavities 47. The inner conductors of the coaxial lines are connected to the arms of the antenna and the outer conductors are bonded together through the height of the cavity. The 90° hybrid circuit is etched on both sides of a central dielectric layer 48. Additional printed circuit boards are placed above and below this central layer. Two coaxial connectors 49 are placed on the bottom of the structure (only one connector is shown). The same feed structure may be used for a four arm conical sinuous antenna by extending the coaxial lines to the vertex of the cone.

FIG. 19 is a top view of the central dielectric layer 48 showing the strip lines 49 forming the 90° hybrid and the balun feeds. The solid and dashed lines show the strips on the top and bottom sides of the layer respectively. The hybrid consists of a tandem connection of two 8.3 db hybrids, 51 and 52 to form a 3 db hybrid. The hybrids may be of the stepped or continuously tapered form. The coupling exists over the lengths 53 and 54 on the right side and similarly for the left side. The couplers are bent at the central region which allows a simple modification of existing straight line coupler designs. The outlines of the two balun cavities 47 are shown by the dashed lines. Symmetry is invoked to minimize beam tilt and axial ratio. Broadside inputs are placed at 56 and 57. The stripline balun feeds are terminated by an open circuit 58, about a quarter wave at the midband frequency past the center of the balun.

Figure 20A:
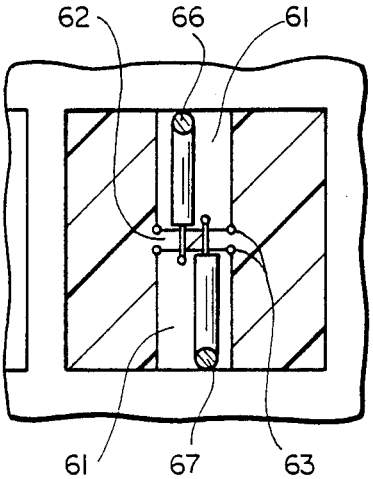
Figure 20B:
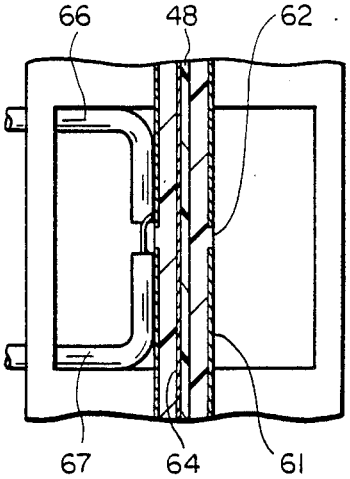

Top and side views of one of the baluns are shown in FIGS. 20*a* and 20*b* respectively. The balun cavity is excited by the three layer strip line assembly shown in FIG. 20*b*. Etched strips 61 (FIG. 20*a*) with a gap, 62, are formed on the top and bottom layers and are electrically connected together by pins, 63, at the gap. The gap is excited by the strip 64, FIG. 20*b*, on the center layer 66. This strip is excited at the top by the hybrid and terminated with an open circuit at the bottom. The coaxial lines 66 and 67 run along the sides of the cavity and the strips 61 and are connected in parallel across the gap. This provides a 4:1 impedance transformation between the balanced output coaxial lines and the input strip line. One hundred ohm coax lines may be used to provide a 200 ohm balanced feed impedance for the antenna (which is close to the input impedance for a self-complementary structure) and a balun input impedance of 50 ohms. For antenna impedances considerably different from 200 ohms, the outer conductors of the coaxial lines may be removed inside the cavity and the spacing of the four remaining wires may be tapered to form a wide band transformer. The two coaxial lines could also be connected in series. However, this would require 25 ohm coax lines and wideband transformers to match the antenna impedance.

FIG. 21 shows a measured elevation pattern at 5 GHZ of a linear-log sinuous wire antenna with four arms. The antenna was planar and cavity backed with a cavity diameter of 2.25". The pattern was measured with a rotating linearly polarized source. The difference between the peak and null envelopes is the axial ratio. It is seen that the axial ratio varies from 0.5 db to 3 db over a hemisphere. The 3 db beamwidth is 78°. Measurements over a 9:1 bandwidth showed similar results with a beamwidth variation of about 10° except for the low end of the band. The beamwidth variation with azimuth angle is very small which indicates that little energy is propagated past the active region. The variation is much less than that for spiral antennas. This produces much better direction finding accuracy.

In order to obtain sum and difference patterns for both senses of circular polarization it is necessary to use five or more arms for the sinuous antennas. Sinuous antennas with an odd number of arms are usually avoided because the feed networks are awkward due to the fact that the practical components split the power an even number of ways. A six arm structure is preferred over an eight arm structure since the antenna is less congested at the center and the feed network is simpler. FIG. 22 shows a six arm feed network for producing sum and difference patterns. The output functions for the 90° hybrids 71 (H) and magic T's 72*a, b, c, d* are defined in FIG. 23. If there is no subscript for H or T, then $\gamma=45°$ and the coupler has equal power outputs. For the $T_1$ coupler of FIG. 22, $\gamma=35.2°$ which gives a 2:1 power split. The antenna terminals are numbered 1 to 6 and the input terminals are labeled by mode numbers $M_m$. The phase progression at the antenna terminals is given by $m\times 60°$. Notice that the feed circuit has 180° rotational symmetry except for the T's at the inputs. Thus, if similar components are identical but not perfect, the boresight error of the difference patterns, $M_2$ and $M_{-2}$, depends upon the quality of the T's at the inputs. Practical considerations for wide bandwidths dictate that each of the components of FIG. 22 be composed of a tandem of two couplers, each with a coupling of $\gamma/2$. Thus, sixteen couplers are required for the network. For most microwave applications, it is then necessary to stack several layers of components with rather difficult interconnection problems.

FIG. 24 shows a more sophisticated feed circuit for a six arm sinuous antenna wherein four tilted beams for both senses of circular polarization are provided. This circuit has more symmetry and provides much smaller direction finding errors than that of the previous circuit. The components labeled IPD are isolated power dividers, usually of the Wilkenson type. A 3 db loss in all of the beams is incurred in order to obtain eight beams. It is analogous to the feed circuits for four arm spirals described by J. A. Mosko (Microwave Journal, Vol. 27, No. 3, pp 105–122). The ports designated $M_1+M_2$ and $M_1-M_2$ produce two beams tilted in opposite directions. The patterns are simply the sum or difference of the sum and difference patterns. The ports designated $M_1-jM_2$ and $M_1-jM_2$ produce two beams tilted in opposite directions in a plane which is orthogonal to the plane of the previous beams. Similar descriptions apply to the four beams of the opposite polarization designated at the top of the figure.

There has been described a new class of quasi-log-periodic sinuous antennas which provide two orthogonal senses of polarization over a frequency bandwidth which is determined by the size of the smallest and largest cells in the structure. The antennas have N sinuous arms placed on a peaked (pyramidal or conical) or planar surface with a symmetry such that a rotation of 360/N degrees about the central axis leaves the structure unchanged. Three or more arms are required to produce sum type patterns and five or more arms are required to produce sum and difference patterns or titled beams simultaneously.

What is claimed is:

1. A sinuous antenna comprising an array of N sinuous arms lying on a common surface each consisting of a sinuous conductor extending away from a common point with the common point the center of a coordinate system (r, $\phi$) with a rotational symmetry such that a rotation of 360/N degrees about an axis containing the common point leaves the structure unchanged, wherein each arm consists of a cascade of cells numbered 1 to P, where 1 is the largest cell and the outside and inside radii of the $p^{th}$ cell, measured from the common point, are given by $R_p$ and $R_{p+1}$ and are related by the design parameter $\tau_p$, which is less than 1, wherein $R_{p+1}=\tau_p R_p$, each cell comprising a conductor portion having a sharp bend with a protrusion and wherein the center line of each sinuous conductor of each cell is defined by a line with the angular coordinate $\phi$ being an oscillating function of the radius and varying smoothly as a function of radius from $\phi_n$ to $\phi_n+\alpha_p$ to $\phi_n$ degrees for one cell and from $\phi_n$ to $\phi_n-\alpha_{p+1}$ to $\phi_n$ degrees for the next cell where the $\alpha_p$'s are positive numbers and $\phi_n$ is the angle to the start of the first cell for the n'th arm and the $\alpha_p$'s are such that the cells of adjacent sinuous arms are interleaved and spaced from one another.

2. A sinuous antenna as in claim 1 in which the common surface is planar.

3. A sinuous antenna as in claim 2 including a cavity on one side of said antenna.

4. A sinuous antenna as in claim 1 in which the common surface is conical.

5. A sinuous antenna as in claim 1 in which the common surface is pyramidal.

6. A sinuous antenna as in claim 1 in which the radius to the line defining the center of the sinuous conductor decreases as a function of distance along the line as measured from the outermost cell.

7. A sinuous antenna as in claim 1 in which the radius to the line defining the center of the sinuous conductor monotonically decreases as a function of distance along the line as measured from the outermost cell.

8. A sinuous antenna as in claim 1 in which said protrusion is a stub.

9. A sinuous antenna as in claim 1 in which said cell conductors connecting to the sharp bend lie in a curve.

10. A sinuous antenna as in claim 1 in which said cell conductors connecting to the sharp bend lie on one or more straight lines.

11. A sinuous antenna as in claim 6 in which each of said sinuous conductors and said protrusion is a strip with the edges of the strips defined by rotating the center line through an angle $+\delta$ and $-\delta$.

12. A sinuous antenna as in claim 11 in which $\delta$ is selected to form a self-complementary structure.

13. A sinuous antenna as in claims 1 or 6 in which said sinuous arms are interleaved with substantially equal and uniform spacing between adjacent arms.

14. A sinuous antenna as in claim 6 in which the common surface is planar.

15. A sinuous antenna as in claim 14 including a cavity on one side of said antenna.

16. A sinuous antenna as in claim 6 in which the common surface is conical.

17. A sinuous antenna as in claim 6 in which the common surface is pyramidal.

18. A sinuous antenna as in claim 11 in which the commom surface is planar and a cavity is disposed on one side of said antenna.

19. A sinuous antenna comprising an array of N sinuous arms lying on a common surface each consisting of a sinuous conductor extending away from a common point with the common point the center of a coordinate system (r, $\phi$) and with a rotational symmetry such that a rotation of 360/N degrees about an axis containing the common point leaves the structure unchanged, wherein each arm consists of a cascade of cells numbered from 1 to P, where 1 is the largest cell and the outside and inside radii of the $p^{th}$ cell, measured from the common point, are given by $R_p$ and $R_{p+1}$ and are related by the design parameter $\tau_p$, which is less than 1 wherein $R_{p+1}=\tau_p R_p$, each cell comprising a conductor portion having a sharp bend and wherein the center line of each sinuous conductor in each cell is defined by a line with the angular coordinate $\phi$ being an oscillating function of the radius and varying smoothly as a function of radius from $\phi_n$ to $100_n+\alpha_p$ to $\phi_n$ degrees for one cell and from $\phi_n$ to $\phi-\alpha_{p+1}$ to $\phi_n$ degrees for the next cell where the $\alpha_p$'s are positive numbers and $\phi_n$ is the angle to the start of the outermost cell for the nth arm and the $\alpha_p$'s and the shape of the sinuous conductors are such that the cells of adjacent sinuous arms are interleaved and spaced from one another.

20. A sinuous antenna as in claim 19 in which a protrusion is located at said bend.

21. A sinuous antenna as in claim 19 in which said cell conductors connecting to the sharp bend lie on a curve.

22. A sinuous antenna as in claim 19 in which said cell conductors connecting the sharp bend lie on one or more straight lines.

23. A sinuous antenna as in claim 19 in which each of said sinuous conductors are strips with the edges of the strips defined by rotating the center line through an angle $+\delta$ and $-\delta$.

24. A sinuous antenna as in claim 23 in which $\delta$ is selected to form a self-complementary structure.

25. A sinuous antenna as in claim 19 in which the common surface is planar.

26. A sinuous antenna as in claim 25 including a cavity on one side of said antenna.

27. A sinuous antenna as in claim 19 in which the common surface is conical.

28. A sinuous antenna as in claim 19 in which the common surface is pyramidal.

29. A sinuous antenna as in claim 23 in which the common surface is planar and a cavity is disposed on one side of said antenna.

30. A sinuous antenna comprising an array of N sinuous arms lying on a common surface each consisting of a sinuous conductor extending away from a common point with the common point the center of a coordinate system (r, $\phi$) and with a rotational symmetry such that a rotation of 360/N degrees about an axis containing the common point leaves the structure unchanged, wherein each arm consists of a cascade of cells numbered 1 to P, where 1 is the largest cell and the outside and inside radii of the $p^{th}$ cell, measured from the common point, are given by $R_p$ and $R_{p+1}$ and are related by the design parameter $\tau_p$, wherein $R_{p+1}=\tau_p R_p$, each cell comprising a conductor portion having a sharp bend and wherein the center line of each sinuous conductor of each cell is defined by a line with the angular coordinate $\phi$ being an oscillating function of the radius and varying smoothly as a function of radius from $\phi_n$ to $\phi_n+\alpha_p$ to $\phi_n$ degrees for one cell and from $\phi_n$ to $\phi_n-\alpha_{p+1}$ to $\phi_n$ degrees for the next cell where the $\alpha_p$'s are positive numbers and $\phi_n$ is the angle to the start of the first cell for the nth arm and the $\alpha_p$'s are such that the cells of adjacent sinuous arms are interleaved and means for providing isolated feeds of the antenna structure which excite the innermost portion of the $p^{th}$ cell of each arm with one or more of the normal modes, where the voltages of a normal mode $V_{n,m}$ are given by $$V_{n,m}=A_m \exp(j\,360\,mn/N)$$

where $n=1, 2, \ldots N$ the arm number $m=\pm 1, 2, \ldots,$ the mode number $A_m$=complex amplitude of mode m.

31. A sinuous antenna as in claim 30 in which N is greater than 2 and two isolated feeds excite modes $M_1$ and $M_{-1}$ separately, where $M_m$ designates the excitation of all N arms in mode m, to provide two beams with opposite senses of circular polarization.

32. A sinuous antenna as in clam 30 in which N is greater than 2 and two isolated feeds excite mode combinations $M_1+M_{-1}$ and $M_1-M_{-1}$ separately, where $M_m$ designates the excitation of all N arms in mode m, to provide two beams with orthogonal linear polarizations.

33. A sinuous antenna as in claim 30 wherein N is greater than 4 and four isolated feeds excite modes $M_1$, $M_{-1}$, $M_2$, and $M_{-2}$ separately, where $M_m$ designates the excitation of all N arms in mode m, to provide sum and difference patterns for each sense of circular polarization.

34. A sinuous antenna as in claim 30 in which N is greater than 4 and eight isolated feeds excite mode combinations $M_1+M_2$; $M_1-M_2$; $M_1+jM_2$; $M_1-jM_2$; $M_{-1}+M_{-2}$; $M_{-1}+M_{-2}$; $M_{-1}-jM_{-2}$ and $M_{-1}-M_{-2}$ separately, where $M_m$ designates the excitation of all N arms in mode m, to provide clusters of four tilted beams for each sense of circular polarization.

35. A sinuous antenna as in claim 30 in which a protrusion is located at each of said bends.

36. A dual circularly polarized antenna comprising:

a number N of identical generally sinuous antenna arms extending outwardly from a common central axis and arranged symmetrically on a surface at intervals of 360°/N about the central axis, each antenna arm comprising cells of bends and curves arranged in a guasi-log periodic manner, each such cell being on said surface and being interleaved, without touching, between adjacent cells of an adjacent antenna arm.

37. An antenna as in claim 36, including:

a plurality of sinuous antenna arms in which bends occur at increasing angular extent from the center line of said arms.

38. An antenna according to claim 36 wherein said antenna arms are formed of thin substantially planar conductive material disposed on an insulative substrate, and wherein the line width of said material is enlarged in the circumferential direction at each bend, thereby providing shunt capacitance to compensate for the inductance of said bend.

39. An antenna according to claim 37 wherein each of said bends has a stub extending therefrom, the reflections produced by said stubs tending to cancel reflections due to said bends.

40. An antenna according to claim 36 wherein the end of each bend is linear and aligned generally radially with respect to said central axis.

41. An antenna according to claim 36 wherein there are four sinuous antenna arms arranged at 90° intervals with respect to each other, together with feed means for driving said antenna sections with a progressive phase shift of +90° or −90°.

42. An antenna according to claim 36 formed on a planar surface, together with an underlying radiation absorptive base.

* * * * *

UNITED STATES PATENT AND TRADEMARK OFFICE

CERTIFICATE OF CORRECTION

PATENT NO. : 4,658,262

DATED : April 14, 1987

INVENTOR(S) : Raymond H. DuHamel

It is certified that error appears in the above—identified patent and that said Letters Patent is hereby corrected as shown below:

Column 3 line 21 after "log-periodic", add --and--.

Column 4 line 39 after "of", add --a--.

Column 5 line 35, equation (3) "P" should be changed to --p--.

Column 6 line 4, equation (7), "P" should be changed to --p--.

Column 7 line 19, equation (11), "p" should be --P--.

Column 7 line 22, equation (12), "p" should be ~~pp~~ --P--.

Column 7 line 27, "$R_p$" should be --$R_P$--.

Column 8 line 16, "m=+1, +2, ..." should be --m=$\pm$1, $\pm$2...--

Column 10 line 60, equation (19), "$(-1)_p$" should be --$(-1)^p$--; and "(1-K)" should be -- $\frac{1-K}{2}$ --.

Column 11 line 59, "that" should be --the--.

Column 12 line 50, "$\theta$" should be -- $\tau$ --.

Column 13 line 6, delete "(22)" .

Column 13 line 9, "$B_p$" should be --$B_P$--.

Column 14 line 54, delete "and ILR $\leqq$ 45°"; and "ILR $\leqq$ 0" should be --ILR $\geq$ 0-- .

Column 20, line 25, "$M_{-1} + M_{-2}$" (second occurence) should be --$M_{-1} - M_{-2}$--; and "$M_{-1} - jM_{-2}$" should be --$M_{-1} + jM_{-2}$--.

UNITED STATES PATENT AND TRADEMARK OFFICE

CERTIFICATE OF CORRECTION

PATENT NO. : 4,658,262

DATED : April 14, 1987

INVENTOR(S) : Raymond H. DuHamel

It is certified that error appears in the above-identified patent and that said Letters Patent is hereby corrected as shown below:

Column 20, line 26, "$M_{-1} - M_{-2}$" should be --$M_{-1} - jM_{-2}$--.

Signed and Sealed this

Twenty-ninth Day of March, 1988

*Attest:*

DONALD J. QUIGG

*Attesting Officer*

*Commissioner of Patents and Trademarks*